US011788776B2

(12) United States Patent
Chen et al.

(10) Patent No.: US 11,788,776 B2
(45) Date of Patent: Oct. 17, 2023

(54) REFRIGERATION UNIT

(71) Applicant: Carrier Corporation, Palm Beach Gardens, FL (US)

(72) Inventors: Linhui Chen, Shanghai (CN); Tingcan Mi, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,166

(22) PCT Filed: Jun. 25, 2020

(86) PCT No.: PCT/US2020/039589
§ 371 (c)(1),
(2) Date: Dec. 1, 2020

(87) PCT Pub. No.: WO2021/003053
PCT Pub. Date: Jan. 7, 2021

(65) Prior Publication Data

US 2022/0113067 A1 Apr. 14, 2022

(30) Foreign Application Priority Data

Jul. 2, 2019 (CN) ..... 201910589095.8

(51) Int. Cl.
*F25B 21/04* (2006.01)

(52) U.S. Cl.
CPC ..... *F25B 21/04* (2013.01); *F25B 2321/0211* (2013.01)

(58) Field of Classification Search
CPC .. F25B 21/02; F25B 21/04; F25B 2321/0211; F25B 2321/0212; F25B 2321/021;
(Continued)

(56) References Cited

U.S. PATENT DOCUMENTS 3,148,511 A * 9/1964 Gable ..... F25B 21/02 62/3.2
5,361,587 A * 11/1994 Hoffman ..... F25B 21/02 62/3.2

(Continued)

FOREIGN PATENT DOCUMENTS

WO 2013095895 A2 6/2013

OTHER PUBLICATIONS

International Search Report and Written Opinion for International Application No. PCT/US2020/039589; International Filing Date Jun. 25, 2020; Report dated Sep. 2, 2020 (pp. 1-13).

*Primary Examiner* — Tavia Sullens
(74) *Attorney, Agent, or Firm* — CANTOR COLBURN LLP

(57) ABSTRACT

A refrigeration unit includes: a refrigeration circuit including a compressor, a condenser, a thermal expansion valve, and an evaporator connected into a circuit; and a heat recovery system including a thermoelectric module, a control module and a battery; the thermoelectric module includes a first side and a second side, the first side being configured to establish a thermal connection with a first heat source and the second side being configured to establish a thermal connection with a second heat source, the first heat source and the second heat source having different temperatures, the thermoelectric module being configured to generate power by the temperature difference between the first heat source and the second heat source; and the control module is configured to store the power generated by the thermoelectric module to the battery, the battery being configured to drive the refrigeration circuit.

5 Claims, 3 Drawing Sheets

(58) Field of Classification Search
CPC ..... F25B 2321/023; F25B 2321/025; F25B 2321/0251; F25B 2321/02
See application file for complete search history.

(56) References Cited

U.S. PATENT DOCUMENTS

| | | | | |
|---|---|---|---|---|
| 5,547,019 | A * | 8/1996 | Iacullo | F25B 21/02 62/3.61 |
| 2007/0101737 | A1 | 5/2007 | Akei et al. | |
| 2014/0123695 | A1 | 5/2014 | Berg | |
| 2017/0089631 | A1 * | 3/2017 | Marty | F25D 21/14 |

* cited by examiner

REFRIGERATION UNIT

CROSS REFERENCE TO RELATED APPLICATIONS

This application is a US National Stage of PCT/US2020/039589 filed on Jun. 26, 2020, which claims the benefit of CN Application No. 201910589095.8, filed on Jul. 2, 2019, which are incorporated herein by reference in their entirety.

TECHNICAL FIELD

The present application relates to a refrigeration auxiliary system. More specifically, the present application relates to a refrigeration unit with a heat recovery system intended to utilize the temperature difference in the refrigeration unit to at least partially recover energy, so as to improve the operating efficiency of the refrigeration unit.

BACKGROUND ART

Refrigeration units are widely used in production and living facilities that require the production of cooling quantity. For example, refrigeration units may be deployed onto moving vehicles, so as to provide Transportation Refrigeration Units (TRU). Transport refrigeration units are typically used to provide moving refrigeration or chilling environment. The refrigeration unit usually includes at least a compressor, an evaporator, a thermal expansion valve, and a condenser. When a conventional refrigeration unit is operating in the refrigeration mode, the power consumed by the compressor and the heat absorbed from the evaporator is discharged from the condenser into the surroundings. In a conventional refrigeration unit, approximately 30% of the heat generated by the combustion of the engine fuel is discharged into the surroundings when the refrigeration unit is actuated by the engine. The discharged heat is not fully utilized.

Accordingly, there is a continuing focus in the art for increasing the operating efficiency of the refrigeration unit. It is desirable that new solutions can improve the refrigeration efficiency of the refrigeration unit.

SUMMARY OF INVENTION

The object of one aspect of the present application is to provide a refrigeration unit with a heat recovery system that is intended to increase the operating efficiency of the refrigeration unit by recovering condensation heat.

The object of the present application is achieved by the following technical solution:

a refrigeration unit, comprising:

a refrigeration circuit including a compressor, a condenser, a thermal expansion valve, and an evaporator connected into a loop; and a heat recovery system comprising a thermoelectric module, a control module and a battery;

wherein, the thermoelectric module (Thermoelectric Cooling, TEC) includes a first side and a second side, the first side being configured to establish a thermal connection with a first heat source and the second side being configured to establish a thermal connection with a second heat source, the first heat source and the second heat source having different temperatures, the thermoelectric module being configured to generate power by a temperature difference between the first heat source and the second heat source; and wherein, the control module is configured to store the power generated by the thermoelectric module to the battery, the battery being configured to drive the refrigeration circuit.

In the refrigeration unit described above, optionally, the condenser comprises a condenser coil and a first fan configured to deliver ambient air through the condenser coil; and wherein, the first heat source and the second heat source are located on the flow path of the ambient air and are located on an upstream side and a downstream side of the condenser coil, respectively.

In the refrigeration unit described above, optionally, the heat recovery system is further configured to conduct refrigeration with the thermoelectric module, so as to reduce the temperature of the ambient air on the upstream side of the condenser coil.

In the refrigeration unit described above, optionally, the thermoelectric module is configured to be arranged about the perimeter of the condenser coil.

In the refrigeration unit described above, optionally, the first heat source is a discharge line of the compressor and the second heat source is ambient air.

In the refrigeration unit described above, optionally, the first heat source establishes a thermal connection with the thermoelectric module via a first heat exchanger.

In the refrigeration unit described above, optionally, the ambient air establishes a thermal connection with the thermoelectric module via a second fan.

In the refrigeration unit described above, optionally, the first heat source is discharge gas of an internal combustion engine and the second heat source is ambient air.

In the refrigeration unit described above, optionally, the discharge gas of the internal combustion engine establishes a thermal connection with the thermoelectric module via a second heat exchanger.

In the refrigeration unit described above, optionally, the ambient air establishes a thermal connection with the thermoelectric module via a third fan.

The refrigeration unit with the heat recovery system of the present application has the advantages of being simple in structure, convenient to use, high in operation efficiency and the like. By employing the refrigeration unit of the present application, thermal energy can be at least partially recycled for the operation of the refrigeration unit, so as to improve the refrigeration efficiency.

BRIEF DESCRIPTION OF DRAWINGS

The present application will now be described below in further detail in connection with the accompanying drawings and the preferred embodiments. Those skilled in the art will appreciate that these drawings are drawn for the purpose of illustrating preferred embodiments only, and therefore should not be taken as limitation to the scope of the present application. In addition, unless particularly specified, the drawings are only intended to conceptually represent the composition or construction of the objects described, and may include exaggerated illustration. The figures are also not necessarily drawn to scale.

DETAILED DESCRIPTION

Figure 1:
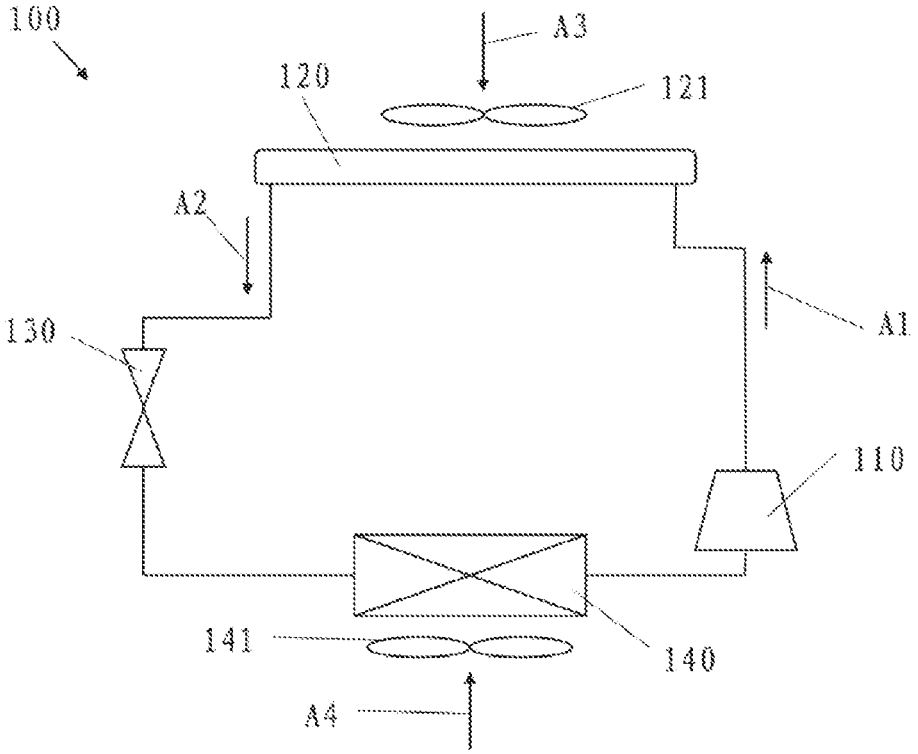
FIG. 1 is a structural schematic view of a refrigeration unit.

Preferred embodiments of the present application will be described in detail below with reference to the attached drawings. Those skilled in the art will appreciate that: these descriptions are merely descriptive, exemplary, and should not be construed as limiting the protective scope of the present application.

Firstly, it is to be noted that the top, bottom, upward, downward, and other directional terms mentioned herein are defined with respect to the orientation in the various figures. They are relative concepts and thus can vary depending on the different positions and the different utility conditions they are in. Therefore, these and other directional terms should not be construed as limiting terms.

In addition, it should also be noted that for any single technical feature described or implied in the embodiments herein, or any single technical feature shown or implied in the drawings, these technical features (or equivalents thereof) may still be continued to be combined, thereby obtaining other embodiments that are not directly mentioned herein.

It should be noted that, like reference numerals designate identical or substantially identical assemblies in different drawings.

FIG. 1 is a structural schematic view of a refrigeration unit. For purposes of clarity, the heat recovery system according to the present application is not shown in FIG. 1. The refrigeration unit 100 includes a refrigeration circuit that typically includes a compressor 110, a condenser 120, a thermal expansion valve 130, and an evaporator 140 connected into a loop. Working fluid is provided within the circuit. In the illustrated embodiment, the working fluid travels generally in a counter-clockwise direction. For example, the working fluid exits the compressor 110 in the direction shown by arrow A1 and enters the condenser 120. The condenser 120 is provided with a first fan 121; the first fan 121 rotates to provide ambient air. The ambient air may flow in the direction shown by arrow A3 and thus establish a thermal connection (i.e., heat exchange) with the condenser 120 and the working fluid therein. The working fluid then exits the condenser 120 in the direction shown by arrow A2.

As used herein, "establishing a thermal connection" refers to the presence of a direct heat exchange relationship and continuous heat exchanging could be conducted.

Similarly, the evaporator 140 may also be provided with an evaporator fan 141 that rotates to provide a flow of working gas. The working gas may flow in the direction shown by arrow A4 and thus establish a thermal connection (i.e., heat exchange) with the evaporator 140 and the working fluid therein. In one embodiment, the refrigeration unit 100 may be a transport refrigeration unit disposed on a movable vehicle for controlling the temperature of air within the vehicle refrigeration compartment.

Figure 2:
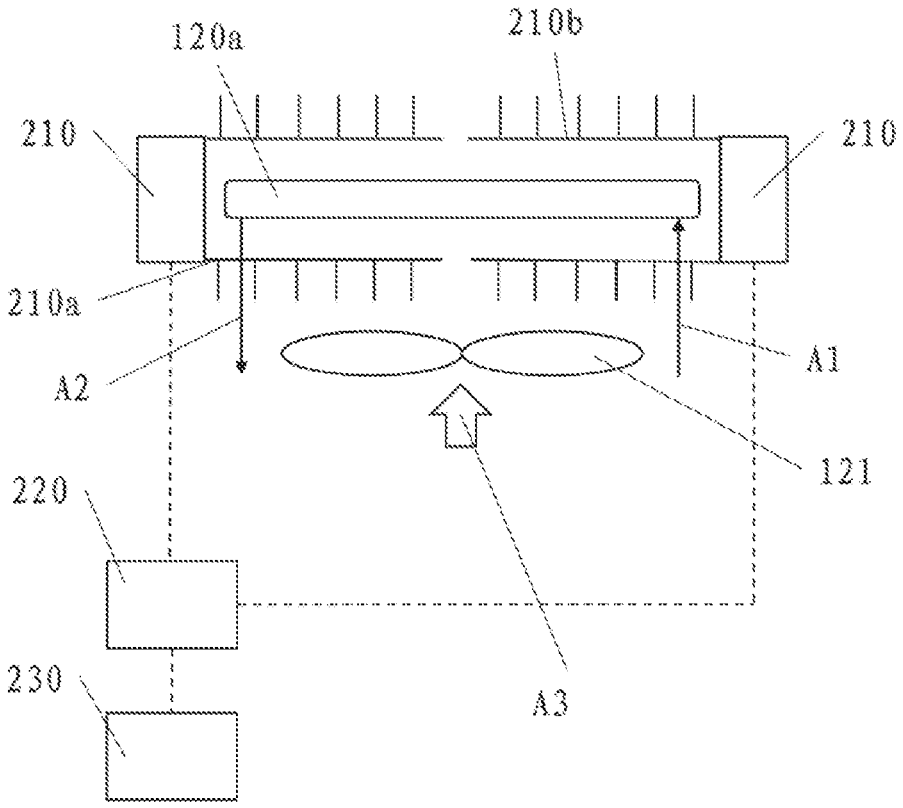
FIG. 2 is a partial structural schematic view of one embodiment of a refrigeration unit according to the present application.

As shown in FIG. 2, the refrigeration unit according to the present application also includes a heat recovery system. The heat recovery system includes a thermoelectric module 210, a control module 220 (also referred to as a controller), and a battery 230. The thermoelectric module 210 includes a first side 210 *a* and a second side 210 *b*. The first side 210 *a* is disposed to establish a thermal connection with the first heat source, and the second side 210 *b* is disposed to establish a thermal connection with the second heat source. The first heat source and the second heat source have different temperatures. The thermoelectric module 210 is also configured to generate electricity by a temperature difference between the first heat source and the second heat source. The thermoelectric module may employ any known temperature difference power generation device suitable for the application. The control module 220 is configured to store the power generated by the thermoelectric module 210 to the battery 230, which may be configured to drive the refrigeration circuit 100. For example, the battery 230 may be applied to directly or indirectly drive one or more of the compressor 110, the first fan 121, or the evaporator fan 141.

Further, the thermoelectric module 210 may be further configured to perform refrigeration operation in order to receive heat through the thermal connection between the first heat source and/or the second heat source, so as to change the temperature of the first heat source and/or the second heat source as desired.

FIG. 2 is a partial structural schematic view of one embodiment of the refrigeration unit according to the present application. The condenser 120 includes a condenser coil 120*a* and a first fan 121. The first fan 121 is configured to deliver ambient air through the condenser coil 120*a*. The working fluid enters and exits the condenser coil 120*a* in the direction shown by arrows A1 and A2. Specifically, the ambient air moves in the direction shown by arrow A3, so as to provide the flow path for the ambient air. The first side 210*a* and the second side 210*b* of the thermoelectric module 210 are disposed adjacent to the first heat source and the second heat source, respectively. The first heat source and the second heat source are located on the flow path of ambient air and are located on the upstream and downstream sides of the condenser coil 120*a*, respectively.

The upstream side, as referred herein, refers to the location at which the upstream of the flow path of the fluid is located, and the downstream side refers to the location at which the downstream of the flow path of the fluid is located. For example, in FIG. 2, since ambient air as a fluid is schematically shown as flowing from bottom to top, the upstream side of the condenser coil 120*a* refers to the lower side of the condenser coil 120*a* and the downstream side of the condenser coil 120*a* refers to the upper side of the condenser coil 120*a*.

As the ambient air flows through the condenser coil 120*a* in the direction shown by arrow A3, the ambient air will establish a thermal connection and perform heat exchange with the working fluid within the condenser coil 120*a*. Specifically, the ambient air at the upstream side of the condenser coil 120*a* will have a lower temperature, while the ambient air at the downstream side of the condenser coil 120*a* will have a higher temperature. Thus, the temperature of the first heat source will be substantially lower than the temperature of the second heat source, thereby establishing a temperature difference between the first side 210*a* and the second side 210*b* of the thermoelectric module 210. The thermoelectric module will thus generate power. At this point, the temperature at the first side 210*a* will be substantially lower than the temperature at the second side 210*b*. Thus, in the embodiment shown in FIG. 2, the first side 210*a* is also referred to as a cold side, and the second side 210*b* is also referred to as a hot side.

Figure 3:
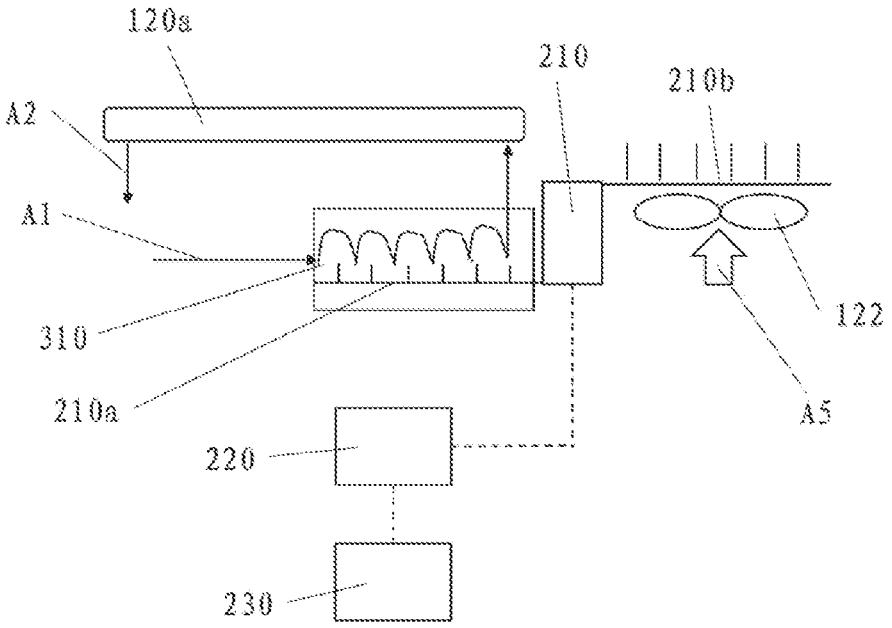
FIG. 3 is a partial structural schematic view of another embodiment of a refrigeration unit according to the present application.
Figure 4:
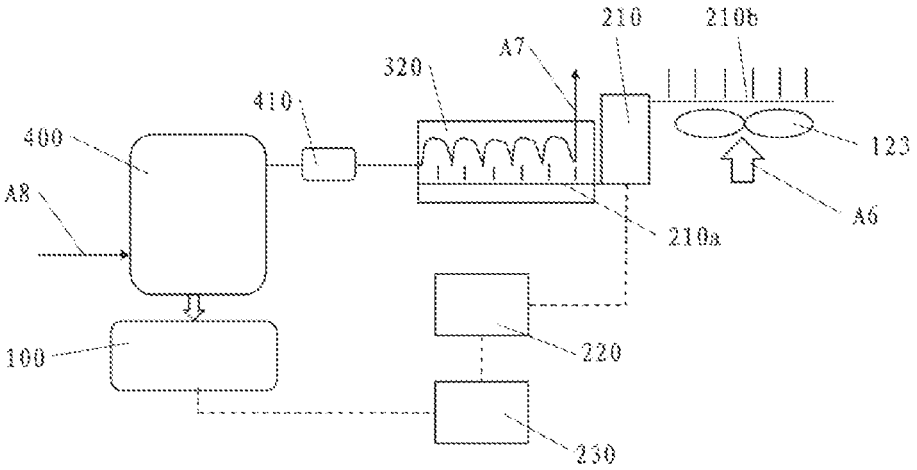
FIG. 4 is a structural schematic view of yet another embodiment of a refrigeration unit according to the present application.

The dashed lines shown in FIGS. 2, 3, and 4 are intended to represent the wires used to deliver power. The power generated by the thermoelectric module 210 is collected by the wires in FIG. 2 to the control module 220. The power generated by the thermoelectric modules may be in the form of direct current and subsequently stored into the battery 230.

In addition, the heat recovery system may further be configured to perform refrigeration using the thermoelectric module 210, so as to reduce the temperature of the ambient air on the upstream side of the condenser coil 120*a*. In this case, the battery 230 is also configured to drive the thermoelectric module 210 such that the thermoelectric module 210 produces a refrigeration effect, thereby reducing the temperature of the ambient air on the upstream side of the condenser coil 120*a*. This function can be used in situations where the refrigeration capacity of the refrigeration unit is insufficient. For example, the refrigeration capacity of the condenser coil 120*a* may be insufficient when rapid cooling is required over a limited period of time. With the auxiliary refrigeration operation of the thermoelectric module 210, rapid cooling operation could be facilitated.

In the illustrated embodiment, the thermoelectric module 210 is configured to be disposed about the perimeter of the condenser coil 120*a*. The thermoelectric modules 210 may also be arranged in other structures or configurations according to actual requirement.

FIG. 3 is a partial structural schematic view of another embodiment of the refrigeration unit according to the present application. In the illustrated embodiment, the first heat source for the thermoelectric module 210 is a discharge line of a compressor (not shown) and the second heat source is the ambient air. The first heat source establishes a thermal connection with the thermoelectric module 210 through the first heat exchanger 310. The ambient air establishes a thermal connection with the thermoelectric module through the second fan 122.

Specifically, as shown in FIG. 3, the discharge line of the compressor (not shown) is connected to the input side of the condenser coil 120*a*, and the working fluid flows in the discharge line, as shown by arrow A1. By installing the first heat exchanger 310 on the discharge line, mounting the first side 210*a* of the thermoelectric module 210 adjacent to the first heat exchanger 310, and disposing the second side 210*b* of the thermoelectric module 210 adjacent to the ambient air, a temperature difference may be obtained between both sides of the thermoelectric module 210. When the refrigeration unit is in operation, the temperature of the discharge side of the refrigeration unit is always substantially higher than the temperature of the ambient air, so it is possible to establish a stable temperature difference. The thermoelectric module 210 generates power with the temperature difference described above, and the power is stored and utilized by the control module 220 and the battery 230. At this point, the temperature at the first side 210*a* will be substantially higher than the temperature at the second side 210*b*. Thus, in the embodiment shown in FIG. 3, the first side 210*a* is also referred to as the hot side, and the second side 210*b* is also referred to as the cold side.

In one embodiment, the thermoelectric module 210 is also operable to provide cooling capacity to the working fluid in the discharge line, so as to achieve the desired temperature regulation purpose. For example, the temperature of the working fluid may be reduced, thereby facilitating the operation of the condenser 120.

The ambient air may be driven by the second fan 122. The second fan 122 may be a fan disposed outside the housing of the refrigeration unit, or a suitable fan in the refrigeration unit could be multiplexed to implement the function of the second fan 122.

FIG. 4 is a structural schematic view of yet another embodiment of the refrigeration unit according to the present application. The first heat source for the thermoelectric module 210 is the discharge gas of the internal combustion engine and the second heat source is the ambient air.

In the embodiment shown in FIG. 4, the refrigeration unit 100 operates in cooperation with an internal combustion engine 400, which may be used to actuate various components in the refrigeration unit 100, for example. The internal combustion engine 400 may draw ambient air in the direction shown by arrow A8, for example. Having subjected to the combustion process in the internal combustion engine 400, the exhaust gas is discharged from the internal combustion engine and moves in the direction shown by arrow A7. The exhaust gas optionally passes through a muffler 410 and then establishes a thermal connection with the first side 210*a* of the thermoelectric module 210 through the second heat exchanger 320. At the same time, the ambient air is driven by the third fan 123 and moves in the direction shown by arrow A6, so as to establish a thermal connection with the second side 210*b* of the thermoelectric module 210. The temperature of the exhaust gas is typically significantly higher than the temperature of the ambient air, therefore it is possible to establish a stable temperature difference. The thermoelectric module 210 generates power with the temperature difference described above, and the power is stored and utilized by the control module 220 and the battery 230. At this point, the temperature at the first side 210*a* will be substantially higher than the temperature at the second side 210*b*. Thus, in the embodiment shown in FIG. 3, the first side 210*a* is also referred to as the hot side, and the second side 210*b* is also referred to as the cold side.

The ambient air may be driven by the third fan 123. The third fan 123 may be a fan disposed outside the housing of the refrigeration unit, or a suitable fan in the refrigeration unit might be multiplexed to implement the function of the third fan 123.

The various embodiments described above may be implemented alone or two or more embodiments might be implemented in conjunction with each other. For example, multiple sets of thermoelectric modules may be provided in the refrigeration unit, and each set of thermoelectric modules may be constructed with the principle of one of the above-described embodiments, respectively. The power generated by the multiple sets of thermoelectric modules may be collected into the same battery for driving the refrigeration unit.

By employing the refrigeration unit according to the present application, heat generated during operation of the refrigeration unit can be utilized to recover power. The recovered power is used for driving the refrigeration unit, thereby the energy consumption of the refrigeration unit is reduced, and the refrigeration efficiency of the refrigeration unit is increased. According to one embodiment of the present application, the power generation efficiency of the thermoelectric module depends on the temperature difference between the first side and the second side. The greater the temperature difference, the higher the power generation efficiency. According to one embodiment of the present application, where the thermoelectric module has a power generation efficiency of 1% to 4%, the refrigeration efficiency may be increased accordingly by 2% to 10%. The refrigeration unit according to the present application may be applied for conventional transportation vehicles using internal combustion engines, as well as electric vehicles that are driven by electric motors.

This description discloses the present invention with reference to the accompany drawings, and also enables those skilled in the art to implement the present application, including making and using any apparatus or systems, selecting suitable materials, and using any incorporated methods. The scope of the present application is defined by the claimed technical solutions, and includes other instances that occur to those skilled in the art. Such other instances should be considered to be within the protective scope of as determined by the claimed technical solutions of the present application as long as they include structural elements that do not differ from the literal language of the claimed technical solutions, or such other examples contain equivalent structural elements without substantial differences from the literal languages of the claimed technical solutions

What is claimed is:

1. A refrigeration unit, comprising:

a refrigeration circuit including a compressor, a condenser, a thermal expansion valve, and an evaporator connected into a loop; and a heat recovery system comprising a thermoelectric module, a controller and a battery;

wherein the thermoelectric module includes a first side and a second side, the first side being configured to establish a thermal connection with a first heat source and the second side being configured to establish a thermal connection with a second heat source, the first heat source and the second heat source having different temperatures, the thermoelectric module being configured to generate power by the temperature difference between the first heat source and the second heat source; and wherein the power generated by the thermoelectric module is stored by the battery, the battery being configured to drive the refrigeration circuit;

wherein the condenser comprises a condenser coil and a first fan configured to deliver ambient air through the condenser coil; and wherein the first heat source and the second heat source are located on a flow path of the ambient air through the condenser coil, wherein the first heat source is located on an upstream side of the flow path of the ambient air through the condenser coil and the second heat source is located on a downstream side of the flow path of the ambient air through the condenser coil;

wherein the first side of the thermoelectric module is located on the upstream side of the flow path of the ambient air through the condenser coil and the second side of the same thermoelectric module is located on the downstream side of the flow path of the ambient air through the condenser coil.

2. The refrigeration unit of claim 1, wherein the heat recovery system is further configured to perform refrigeration with the thermoelectric module, so as to reduce the temperature of the flow path of the ambient air located on the upstream side of the condenser coil.

3. The refrigeration unit of claim 1, wherein the thermoelectric module is configured to be arranged about a perimeter of the condenser coil.

4. The refrigeration unit of claim 1, wherein the condenser coil is positioned between the first side of the thermoelectric module and the second side of the same thermoelectric module.

5. The refrigeration unit of claim 1, wherein the first side of the thermoelectric module is a cold side of the thermoelectric module and the second side of the thermoelectric module is a hot side of the same thermoelectric module, ambient air contacting the first side has a lower temperature than ambient air contacting the second side.

* * * * *